United States Patent [19]

Morrell

[11] 4,191,630

[45] * Mar. 4, 1980

[54] PROCESS FOR THE PRODUCTION OF SHALE OIL FROM OIL SHALES

[76] Inventor: Jacque C. Morrell, 4501 Connecticut Ave. #516, Washington, D.C. 20008

[ * ] Notice: The portion of the term of this patent subsequent to Aug. 8, 1995, has been disclaimed.

[21] Appl. No.: 926,638

[22] Filed: Jul. 21, 1978

Related U.S. Application Data

[63] Continuation-in-part of Ser. No. 769,885, Feb. 18, 1977, Pat. No. 4,105,536, which is a continuation-in-part of Ser. No. 679,315, Apr. 23, 1976, abandoned.

[51] Int. Cl.[2] ..... C10G 1/02

[52] U.S. Cl. ..... 208/11 R; 48/197 R; 201/16; 201/43

[58] Field of Search ..... 208/11 R

[56] References Cited

U.S. PATENT DOCUMENTS

| | | | |
|---|---|---|---|
| 3,481,720 | 12/1969 | Bennett | 208/11 R |
| 3,484,364 | 12/1969 | Hemminger | 208/11 R |
| 3,691,056 | 9/1972 | Barney et al. | 208/11 R |
| 3,925,190 | 12/1975 | Whitcombe et al. | 208/11 R |
| 4,105,536 | 8/1978 | Morrell | 208/11 R |

*Primary Examiner*—Herbert Levine

*Attorney, Agent, or Firm*—Larson, Taylor and Hinds

[57] ABSTRACT

The invention relates to a continuous process to produce shale oil from oil shales. It comprises an improvement, the purpose of which is to remove relatively small and up to substantial amounts of the water present as steam; and to prevent pitch formation, and "stickiness" in a second or retorting stage of the process, carried out at a much higher temperature.

The first step may consist of a fixed vertical vessel in one aspect of the process or alternately a much smaller rotating horizontal vessel than that used in the second step of the process. The first step is conducted at a temperature from ambient, preferably 212° F. up to 550° F. The second or retorting step is conducted at 800° F. to 1000° F. Indirect heating of the oil shales is employed in all cases.

3 Claims, 8 Drawing Figures

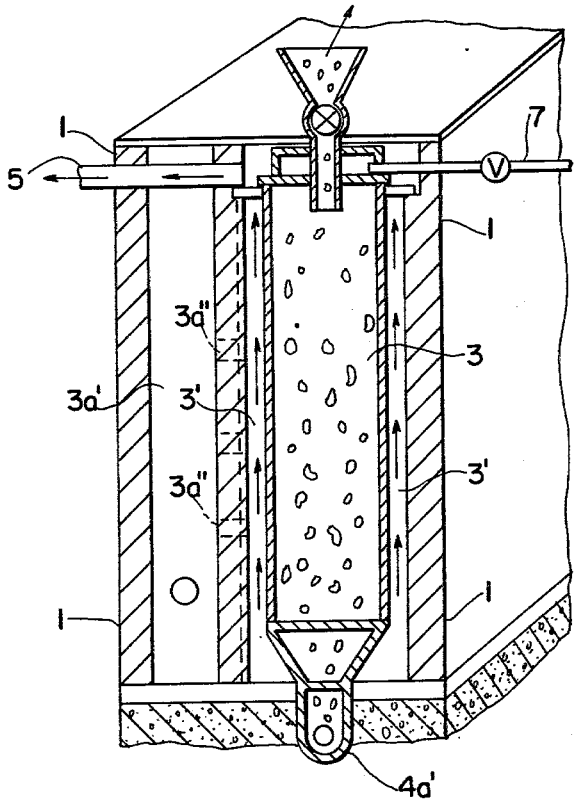
FIG. 1
FIG. 1b
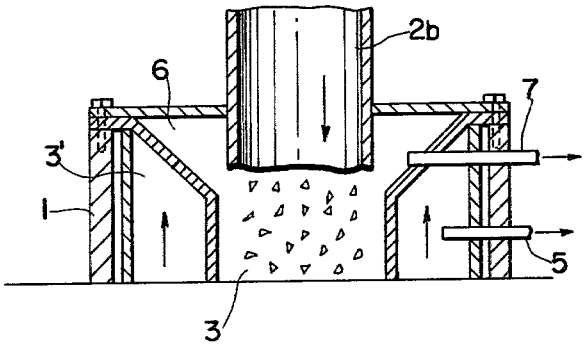
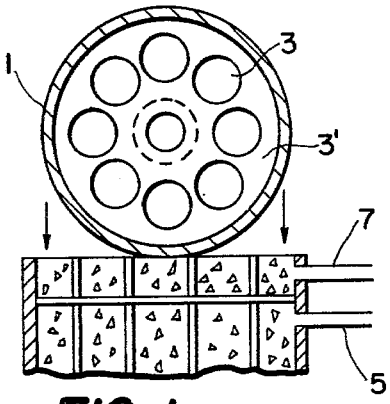
FIG. 1a
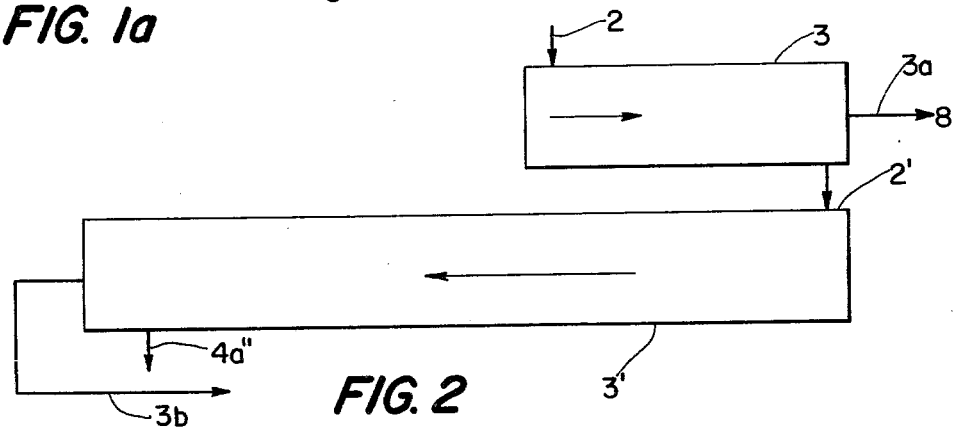
FIG. 2

PROCESS FOR THE PRODUCTION OF SHALE OIL FROM OIL SHALES

BACKGROUND OF THE INVENTION

The present invention is a continuation-in-part of Ser. No. 769,885 filed Feb. 18, 1977 and now U.S. Pat. No. 4,105,536 which in turn is a CIP of Ser. No. 679,315 filed Apr. 23, 1976 now abandoned, all aimed to practical processes to replace our rapidly diminishing supplies of petroleum and liquid fuel distillate including gasoline (both motor and aviation fuels), jet fuels, deisel fuels and burning oils.

It is especially noted that the process described in Ser. No. 769,885 includes the partial dehydration or first step which inherently provides protection against pitch formation or "stickiness" in the retorting or second step of the process with probable "shutdown".

DESCRIPTION OF THE PRIOR ART

The prior art regarding oil shales relates mainly to the design and operation of oil shale retorts in Scotland and France and more recently in Australia as well as some lesser operations in other countries. The above foreign experience goes back for more than a century and some improvements have been made mainly in surface retort design largely on a repetitious pilot plant basis; and some inconclusive and to a large extent wasteful underground retorting referred to as "in situ"; therefore there is little basis of comparison between the prior art of the past with the requirements of the future oil shale industry in the United States. The reason for this is because of the very limited objectives of the past both with regard to type and variety of products and uses of the same as well as the required capacities demanded without waste of the oil shale undergoing treatment and contamination of the products of the process as a result of direct heating instead of indirect heating as employed in the present process. To cite the Scottish experience, which was limited in capacity particularly from the viewpoint of plant design and operation and their objectives to make maximum yields of both ammonia as well as refined oil products (including lubricating oil, kerosene and waxes). These objectives seriously limited capacities of the retorts. Moreover, on the basis of present and future requirements; as the results with respect to the latter, and indeed most recent developments are, far below requirements for projected U.S. petroleum refining and products and practices, including those of the improvements made in the last half century. Comparison of foreign results referred to above because of the era and the completely different present objectives as indicated above, therefore cannot be made. Development, including some worthy research in the subject, generally in the United States, over the past 50 years has been limited with regard to production and in capacity (although not in size and cost); mainly to pilot plant retorts of a variety of design. The merits of most of these efforts from the viewpoint of present requirements were not satisfactory and very largely remain to be proven, in fact, most in general have been found to be completely unsatisfactory. No unitary and continuous process comparable to that shown herein and previous related developments has been disclosed in the prior art.

SUMMARY OF THE INVENTION

The abstract of the disclosure above is a brief summary of the invention which does not, however, describe the necessary details to show capacity, flexibility and continuity over long period demanded from the process as is shown below. It does, however, outline basic principles of the invention as disclosed in sections in the text and Figures which represent respectively in outline the important features and sections of the process of the invention. In addition to the above, additional and alternative features are shown in the figures. The main features are, however, intended to remedy the capacity aspects of the oil shale retorts of the prior art when applied to projected United States requirements with respect to types and quantities of products for modern needs. This includes the equipment and process, novel unitary and continuous for mass production to which the invention is directed, with later conversion at the refinery to principal distillate products referred to in my issued U.S. Pat. No. 3,954,597, (and the claims allowed in my application No. 769,885); as well as additional improvements regarding the capacity and thruputs to meet the aforesaid demands; with maximum economy and simplicity of operation of national security and independence.

PREFERRED EMBODIMENTS

The preferred embodiments for pretreatment of the oil shale are FIGS. 1 and 2A (the latter utilizing a shortened version or reduced capacity) of the first steps, utilizing the horizontal rotary vessel in both steps of the process.

BRIEF DESCRIPTION OF THE DRAWINGS

FIG. 1 relates to an alternate fixed shell vertical tubular oil shale retort design with ceramic and/or fire-brick setting preferably made up of a number of separate elements arranged as a battery of retorts. The horizontal type of rotating retort FIG. 2A, however, has special merit as the preferred type. In general, the retorts are intended to be fully equipped with gas producers and other sources of by-product fuel as illustrated in FIG. 4 and in general as more fully described below. FIGS. 1*a* and 1*b* embody additional types of fixed vertical vessels.

It is noted that the temperatures employed in the first step of the process has a wider range of lower temperatures than the retorting or second step of the process. Also that the preliminary step receives its heat in general from the hot waste gases leaving the retorting step; and the process in general has a high degree of operating flexability.

The fixed vertical shell is less costly for partial dehydration to prevent "pitch" formation; whereas the use of the shortened version (less capacity) of the rotary retort in the preliminary step not only prevents pitch formation in the retorting step but serves to recover much more oil and remove more water than the fixed vessel in the first step of the process utilizing only waste hot gases from the retorting (second) step as a source of heat employing the indirect method as a source of heating; with proven reliability and high capacity of the equipment.

Figure 3:
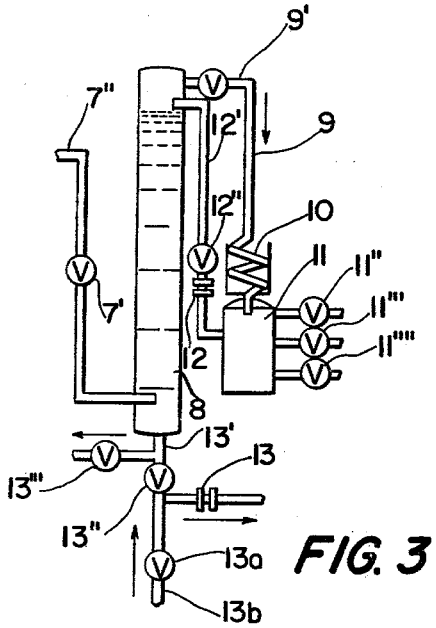
FIG. 3 illustrates the fractionator, condenser and receiver used in the process.
Figure 4:
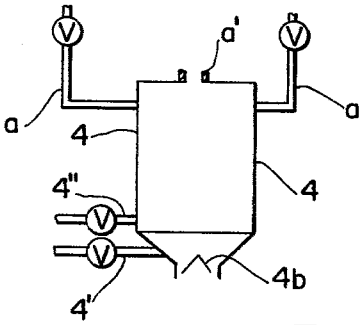
FIG. 4 illustrates a gas producer wherein the carbonaceous substance in the spent shale is converted to producer gas (by treatment with steam and air) and utilized as fuel for the process.

In either case the first or preliminary step of the process serves to heat the oil shale so as in varying degrees to remove a considerable part of the water and in any event sufficient to avoid "stickiness" or pitch formation in the retort section of the process and thus avoid interference with the overall operation. This takes place along with the removal of some low boiling hydrocarbon distillate and reduces the burden of water and oil (dependent upon temperature range) from the principle shale oil 2A rotary retort, and at the same time the capacity of the latter is substantially increased. FIG. 3 depicts the fractionator and partial condenser which permits separation of an overhead product from the various types of partial dehydration or pretreatments and the rotorting step of the process consisting of a light oil distillate comprising mainly low boiling hydrocarbons and water which are condensed and collected in a receiver; as well as ammonia and hydrocarbon gases which are recovered, the latter being utilized as fuel. The major heavier oil product collects in the bottom of the fractionator and is cooled and pumped to storage or if desired sent while hot for further treatment as dislcosed in 769,885 of the process for conversion of the heavy shale oil fraction to a product which may be readily transferred without congealing to a refinery for further processing to fuel distillates, as described in the other parent application No. 679,315 and my issued U.S. Pat. No. 3,954,597. FIG. 4 illustrates a gas producer which is part of and supplies fuel to the retort system (FIGS. 2 and 2A), and which utilizes the by-product solid fuel consisting of spent oil shale to convert the carbonaceous material therein to produce gas as fuel for the process in addition to the hydrocarbon gases produced therein.

Figure 2A:
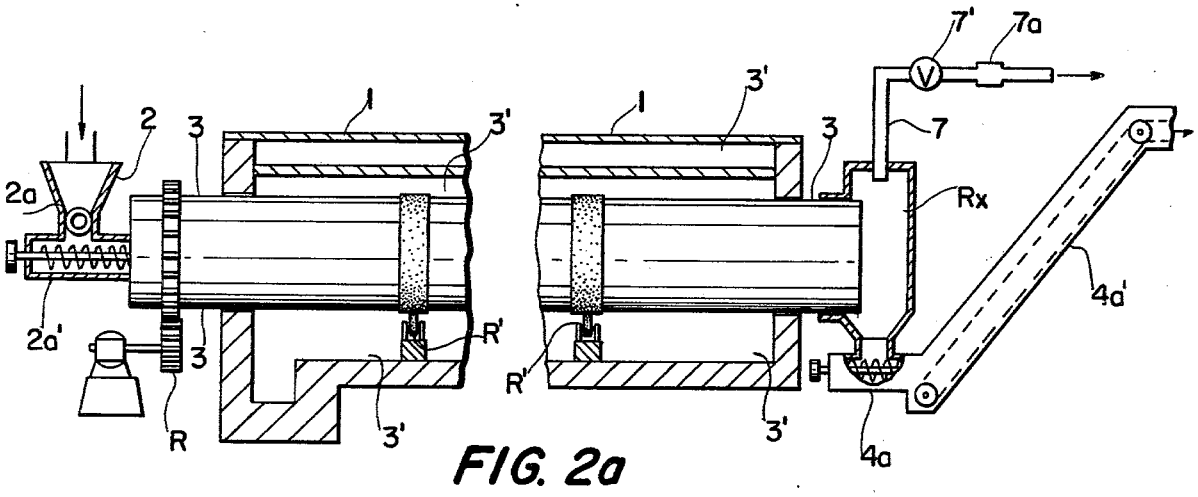
FIG. 2 illustrates the flow of oil shale in two successive rotary retorts (the first of lesser capacity) of the type shown in FIG. 2A referred to above.
FIG. 2B is a cross-section of FIG. 2A.
Figure 2B:
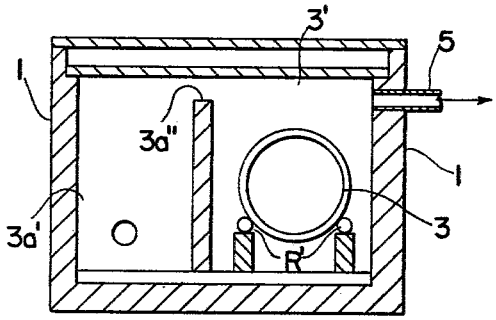

It is noted here that FIG. 2B represents a cross-section of FIG. 2A depicting rotary retort and furnace.

The invention generally relates to the treatment of oil shales to provide raw material for oil distillate products therefrom and more particularly relates to the process of treating the said oil shales in a relatively economical, practical unitary and substantially continuous process to produce an oil product which may be readily transferred to a refinery from the mine sources; and to produce directly by cracking, and other operations at the refinery various distillate products including gasoline and fuels generally for aircraft and automotive vehicles, and burning or heating oils suitable as domestic fuels, diesel oils, jet fuels and similar distillate fuels suitable for various uses including e.g. as raw materials for petrochemicals, etc., and as an alternate or substitute source for similar distillate products from petroleum. Moreover, it is intended to replace the latter and to meet the requirements thereof in all respects during critical periods such as the Middle East embargo aimed at a denial of necessary petroleum supplies; and in fact it will serve to replace petroleum products in the future when petroleum production and supply decreases; which is already a rapidly developing situation substantially below normal and in fact fails to meet minimum requirements; especially under embargo conditions. In any circumstances and from any viewpoint the time for developing an oil shale industry, it now!

With regard to the general subject of oil shale, from the mineralogical viewpoint, an oil shale is basically a rock of sedimentary origin (normally from clays) which has the composition structure and formation of a shale generally (although alternatively considered by some as having a marl base). However, it does not yield oil on extraction with solvents. Oil shale is black or dark brown and when broken is generally with a conchoidal fracture. It contains a substance generally referred to as "kerogen" which on destructive distillation by heat treatment at or somewhat above a dull red heat and higher, produces an oil product generally similar to a hydrocarbon oil from petroleum, as well as hydrocarbon gas; and in addition, it produces nitrogen bases, and ammonia; the latter generally in aqueous solution, since water is also a product of the heat treatment.

Oil shales are found in very large amounts in several parts of the United States as well as in other locations throughout the world. The oil shale deposits in the Green River Formation in Colorado, Wyoming and Utah, etc., are generally of good quality and occur in vast quantities; and as shown below, oil shales occur in other parts of the United States.

As a general guide the amounts of oil produced varies with the type of oil shale and conditions of treatment as well as other factors. As a further guide, a large percentage of the oil shale brought from the Green River Formation in Colorado, Wyoming and Utah and in some other parts of the United States may produce from 20 to 25 gallons (about one half barrel) per ton, and upward of 40 gallons per ton in some cases; although occasional beds in this formation may show about 60 to 90 gallons per ton on a selective basis. Comparable yields of oil from lesser known deposits may be found in Nevada and California, and to some degree in Montana. Oil shale deposits are also found in the Midwest and the eastern part of the United States, e.g. Illinois, Kentucky, Ohio, New York, Pennsylvania, West Virginia and Tennessee; and oil shale in the same general formation (Devonian) yielding notable quantities of oil have been reported in Missouri, Kansas and Oklahoma. The latter are of lesser quality with respect to yield of oil than the Green River Formation, i.e. about 16 gallons per ton.

Recent estimates, reported in connection with the embargo crisis, state that the oil bearing shale in the Green River Formation which runs through Colorado, Wyoming and Utah contains as estimated 600 billion barrels of shale oil, enough to fill the country's needs at current consumption levels for about 100 years, and of course, to this may be added estimates of the very considerable Devonian Formation.

Reports on mining oil shale indicate the practicality of the room and pillar method in the Green River Formation with the added advantage over coal of greater structural strength of oil shale and less liability of gas formation and explosions. The Devonian Formation is amenable to strip mining having definitely in mind the environmental problem and at the same time the solutions which have been successfully applied thereto. Water is available, but, in general, the time has arrived when its proper allocation must be considered on a national basis; and known technology such as recycling, etc. applied as required. The Colorado River rises in the Green River Formation and the need for fuel distillates is definitely of significant national importance to warrant a technically controlled allocation.

It may be noted in connection with the present improvement of my invention that a typical oil shale, e.g. from the Green River Formation (Colorado, Wyoming, and Utah) which may produce from 20 to 40 gallons of oil per ton (and in some cases as much as 90 gallons) may also contain a considerable amount of water, e.g.

about one-quarter of the oil. The oil is produced on heat treatment of the kerogen (the parent substance). The latter under the microscope has a structure indicating its derivation from plant life. The water produced on retorting evidentally traces back to the underwater formation of the oil shale. It is well known that conversion of kerogen to oil by high temperature treatment is a chemical reaction; but it is not so well known that the water appears likewise to be "chemically or otherwise bound" because of the abnormally long time and high temperatures required to release the water. For example, it is well known that many of such compounds referred to as "azeatropes" have been identified.

Before proceeding to a detailed account of my present invention, the following is a brief description of some of the underlying principles which I have discovered relative to the present improvement, which is also in part the basis of the U.S. Pat. applications No. 679,315 and 769,885 from the capacity viewpoint in the translation of the shale oil industry from the viewpoint of capacity to replace the petroleum industry as required.

I have found over a range of increasing temperatures that the water in oil shale does not exhibit its normal behavior as a single compound, e.g., boiling at a constant temperature and in effect resembles an azeotrope compound. Moreover, its rate of release is considerably slower and continues to occur at much higher temperatures than "free water", but, of course, after relase retains its normal properties. It does, however, evolve at a much more rapid rate than the production and/or release of the oil which incidentally is a mixture that has a wide range of boiling points.

With regard to the parent case 768,885 comparison in one set of tests showed that in the above connection at a maximum temperature of 860° F. six hours were required to complete the "Distillation" of both oil and water or release on retorting; however, at a maximum temperature of 985° F. the retort distillation or release rate on a comparative basis of all the water and oil (at different rates) was completed in two hours. It is therefore noted that the overall rate of release of oil and water is mainly dependent upon the prevailing temperature in the retorting step which is essentially the same as in the parent case. This is of oil shale illustrated in the retort section FIG. 2A of the process especially from the viewpoint of comparative capacity; also since the temperature ranges in the pre-treatment step affect the capacity to a much lesser degree.

The following data in the above connection is significant with respect to the preliminary treatment of the oil shale to remove a substantial portion of the water for the purpose of control in increasing retorting capacity. In a series of tests on the relative rates of removal of water on an approximate basis, it was shown that in the first hour of retorting at an approximate temperature of drying about 220° F. more or less than about 25% of the total water was removed whereas only about 10% of the extracable total oil (low boiling) was removed under the same conditions. During a somewhat longer period at a temperature range between 400° F. and 520° F. somewhat less than 50% of the water was removed and only about one-third of the oil recovered. The rate of water removal at these comparatively much lower preretorting temperatures are thus seen to be much greater than oil removal, and is much less than in the U.S. Pat. case No. 769,885, especially at the lower temperature ranges.

From the evidence set forth above, it is concluded that from the ambient a selection of a period of about one hour at 212° F. to 220° F. in the lower range up to a maximum of about 500° F. to 550° F. in the upper range would provide a suitable drying period to remove up to about one-half of the water present and at the same time, a light hydrocarbon distillate, and with a flexability of operation as well as reduction in cost of equipment for the first step of the process; especially from the viewpoint of the equipment for the first step of the process. It is especially noted that in all cases heat is applied to both steps of the process indirectly.

It is also noted in connection with all of the above that the source of heat employed to heat (preferably indirectly) the preliminary step may be obtained from the otherwise normally hot stack gases from the retorting step of the process which relieves the need of any primary fuel used therein or additional costs. Using the above procedure, as pretreatment, removes a very considerable burden from the retorting step (especially at the higher temperature ranges) and thus increases its capacity by a very considerable amount. Moreover, by increaing the operating temperature of the retort from about 800° F. to 900° F., up to 950° F. to 1000° F. the above residence time in the retort is greatly reduced and the capacity increased accordingly. Furthermore, it simultaneously increased in the indirect heating surface of the retorting step (by increasing the diameter and length) of the horizontal retort e.g., up to 10 to 12 feet, results in a tremendous increase in the retort capacity over that contemplated or achieved in the past more particularly together with the prehydration or preliminary step treatment. In general while both steps of the process each perform important functions; equipment for the dehydration step is much less costly but still accomplishes its primary purpose, and the retorting step achieves its maximum capacity as well as continuity of operation.

The effect of the use of the above procedure results in the elimination of cumbersome and/or costly procedures (compared to other proposed processes aside from questions about plant and operating costs, and in this regard the practicality of the process); and instead solves a most important problem in connection with the industrialization of oil shale as a viable industry commensurate with that required to replace the petroleum industry, especially from the viewpoint of capacity and simplicity of operation.

In general, it is noted that FIG. 1 is a typical vertical retort, (generally intended to represent a battery of a number of units of the type depicted, to be used as alternative in some cases to the rotary type, all in the same setting and receiving their heat from the same source. It is further noted that the furnace or heating setting in FIG. 1 is a fire brick or similar ceramic material but the retort itself is iron or steel and for heat transfer and to facilitate passage of oil shale and residue. The general principle or heating is the same as used in general with respect to keeping combustion gases 3' separate in all cases from the oil vapors and hydrocarbon gases 3 (as illustrated in FIG. 1) resulting from the decomposition of the descending oil shale to produce oil and gas in the vertical retort.

With regard to FIG. 1 it is noted that: "1" represents the outer fire brick walls of the furnace setting and "3*a*" the inner wall; "5" represents combustion products exit and "7" the vaporous and gaseous products from the oil shale. Note that the feed control is designated number 2.

FIG. 1*a* represents a diagramatic circular stationary or fixed retort wherein "1" is the outer wall; 3 represents an multiplicity of tubes for the passage of the oil shale and 3' the top of the retort. The space around the tubes is for the hot gases for indirect heating of the oil shale; 5 is exit of that combustion gases and 7 exit for the vapors and gaseous products of the process. FIG. 1*b* is likewise a circular stationary fixed retort wherein the oil shale is passed thru a single large tube 6 entering via 2*b* to be heated indirectly by hot waste combustion gases, and the vaporous and gaseous oil shale products of the process are passed through 7 to a fractionator. The waste gases of combustion leave the system at 5 and are sent to the stack.

With regard to retort design relating to capacity (or throughout) of oil shale, heat transfer and operating questions generally such as charging the heating tubes etc. FIG. 1*a* and FIG. 1*b* illustrate a basic design utilizing a multiplicity of heating tubes and distribution of the same, and another shows a single large heating tube. The full circle in 1*a* illustrates (when properly centered) a satisfactory design, the dotted circles illustrates an area for compromise of location. In both cases a separate triangular cross section or other device) may be fitted to promote downward movement of the oil shale into the heating tubes. FIG. 1*b* illustrates a large heating tube or in effect a large single tube retort with special top designed to promote flow of the oil shale (in effect a funnel shaped top) and arrangement for fitting the various elements together. This of course could be varied in relative sizes or diameters. It may be noted that in the case of this type of retort design the setting or outer walls could very well be made of fire brick or suitable ceramic material for heating and flow of combustion gases and the metal flues fitted therein for the passage of oil vapors and gases therein maintaining the general principle of keeping the latter separate from the combustion gases. In the event of special cases where there is need for a positive mechanism to move the oil shale charge into the flue a revolving metal rake suspended on a vertical shaft rotating on a bearing and supported by the underside of the feed hopper and geared on a motor outside the retort or other suitable arrangement to serve the purpose.

In addition to the above comments, the following is to be noted in connection with design, operation and use of the fixed shell vertical equipment; namely that its principal function is to avoid the tendency for the "pitch" from the heated oil shale to stick to the inner sides of the retort or second step of the process as a result of the release of steam and heat treatment in the preliminary or first stage of the process. It cannot of course compete with the two stage rotary retort process on the basis of capacity, but is less expensive; and in general the latter is preferred.

It is also noted in connection with the above that the vertical tubular may be used in various sizes and arrangements as shown herein e.g. the latter may be flared by gradually increasing the diameter of the tube from about one-fourth to one-third from the top to the bottom to slope the inside of the tubes somewhat outwardly.

With particular reference to the flow diagram FIG. 2, utilizing the preferred rotatry horizontal vessels the oil shale is subdivided by crushing or otherwise breaking it into suitable sizes, e.g. from one-fourth inch to one inch or more or less. It is then introduced into the first step, i.e. a rotating horizontal vessel 3 (shortened for preliminary treatment and lower in capacity than the second or retorting step, designated as 3' in FIG. 2 in effect a partial preliminary dehydration system which in general consists of means for applying indirect heat, preferably from hot waste gases, etc., (such as combustion gases en route to the stack) e.g. from the second or the retorting step to heat the oil shale and to remove via line 3*a* a substantial portion of the water dependent on the operating temperature (together with dissolved ammonia contained therein), and usually together with some light hydrocarbon distillate) which are then condensed and collected at collector 8 spent shale is removed via 4*a*" and product via line 3*b*. Details of the horizontal rotating vessels employed are shown in FIG. 2A including a preliminary oil of lesser capacity, and cost and a practically identical vessel operating at a higher temperature range except for size and greater capacity and volume is used to remove the heavy oil (and remaining water) and recover the same for further treatment. The partially dried oil shale from the first step of the process is fed into the main retort system 3' at considerably higher temperatures to remove the remainder of the water and light oil as overhead products and more particularly the heavier topped crude shale oil, collected from the bottom of the fractionator, connected to the retort, which is then cooled and pumped to storage (or may be pumped while hot to a viscosity breaking Section as an overall continuous process described in the parent case). It is noted therefore that FIG. 3 of the present invention for fractionation, cooling and condensing the overhead liquids is an integral part of the entire process all of which has both novelty and utility. The U.S. Pat. case No. 769,885 employs two rotary horizontal vessels in tandem which includes therein both under the high capacity temperature conditions already described therein. However, other similar combinations may be employed, although the preceding is preferred since the present invention covers a wider choice.

The foregoing is a statement of basic principles and preferred types of equipment of my invention. The following relates to the horizontal rotating cylindrical equipment as shown in FIG. 2A employed in tandem for partial dehydration and retorting as shown in the flow diagram in FIG. 2 Referring to FIG. 2A the shale which is fed through hopper 2 the latter being equipped with feed mechanism 2*a* which permits the oil shale to pass into the retort 3 while preventing the gases and vapors evolved in the retort from escaping. The oil shale which is previously crushed to suitable sized of pieces, preferably from about one-half inch to one inch more or less, and utilizing the fines, e.g. down to one-quarter inch and less for retorting. The vessels pretreatment retort which in the present case are of the horizontal rotary type (e.g. FIG. 2A) may be arranged in a battery of several units (e.g. in tandem pairs for partial drying or preliminary treatement and retorting as in FIG. 2) convenient to meet production requirements and to maintain a balance between capacities of the partial dehydrators (or preliminary treatment step) and retorts in subsequent steps of the process. The latter, as shown in flow sheet FIG. 3 is an integral part of the process which will serve generally a number of partial dehydrators and retorts, e.g. in a battery. Into the first cylinder designated as 3, the oil shale passes in for partial drying (or preliminary treatment generally) and then into the second horizontal cylindrical vessel to be heated and decomposed by the hot gases passing around the outside surface of the retort; (i.e., by indirect heat) resulting from the combustion of fuel which may be, either or both, producer gas referred to above may be made from the spent shale containing a high carbon content; as well as other types of carbonaceous materials if necessary and available e.g. coal, coke etc. Also other types of gas producers may be employed.

The ash from the spent shale may be used as fill in the mine, and may also be used for various useful products referred to below, such as cement, various catalysts and the like.

The fuel employed is from the gas producer, FIG. 4, which in general employs by-product or other carbonaceous materials passing through opening a' into the producer's while hot with means lines 4' and 4" for introducing steam and air respectively and passes to various heating vessels particularly the rotary retort to be burned in the annular space around the heating vessels in closely controlled coordination with air, employing, of course in all cases the necessary control valves and safety and heat efficiency means. Air is supplied to the combustion zone controlled by suitable valves, and separate lines provide fuel gas when needed from other sources. The burning gas around the rotary retort and hot gaseous products of combustion may pass the moving oil shale, (likewise illustrated) in concurrent flow, but out of contact with each other, to avoid mixing combustion gases with the oil vapors and product gases from the process, but in heat transfer relationship with each other. The hydrocarbon oil vapors and gases which are the desired product of the reaction produced by the conversion of the major portion of the active oil forming substance in the oil shale (referred to as "kerogen", etc.) pass together with the oil shale and are separated after leaving the rotating retort.

The partial dehydration system described in connection with the parent cases (Ser. Nos. 679,315 and 769,885) particularly was designed to operate in conjunction with a number of horizontal rotary retorts in pairs, whereas in the present system and operation a fixed shell vertical vessel followed by a rotary horizontal vessel or alternatively, two rotary horizontal cylinders arranged in tandem or side by side as shown in FIG. 2 are employed, the first functioning as a partial drying or preliminary treating system, the second as a retorting system each under the conditions set forth above to accomplish the intended purpose of avoiding pitch formation in the retorting step of the process and insuring continuity thereof as well as increased capacity thereof. This arrangement may of course be coordinated with the cracking section (in one of the parent cases); and/or with the viscosity breaking section of the U.S. Pat. case No. 769,885. The present case (as well as the parent case) make a relatively inexpensive and convenient process arrangement or unit which may be simply multiplied to achieve the very large capacities required for modern petroleum practice; more particularly since the capacity factor has been built in each unit as described above, or balanced in each unit as required.

Regarding FIG. 2: 1 is the top outer furnace closure; 2 is the oil shale feed entrance to control feed; 2*a* is a speed mechanism to central feed; 3 is a rotary horizontal retort; R' are the rollers for the horizontal retort; and R is the gear mechanism between the motor and retort, FIG. 2*b* is a cross-section of the furnace following FIG. 2*a*, namely the horizontal rotary retort and "1" is the outer side walls of the furnace system; "3" is the horizontal rotary retort; "3'" is the inner top of the furnance; "3*a*" is the firing zone of the furnace and "3*a*'" is the partial dividing wall between the firing zone and the rotary retort.

Since essentially the same type of unit rotary retort as explained above may be employed under different conditions to accomplish the desired results, a detailed description of the equipment and operation is given below in connection with FIG. 2A. FIG. 2A shows details of the rotating horizontal cylinder or retort (suitable for use in both stages 3 and 3' in FIG. 2) preferably sloping downward to induce passage and discharge of the oil shale undergoing treatment. The latter as explained is fed into hopper 2 with feed mechanism 2*a*, and additionally 2*a'*, and passes through the retort. The discharge and control mechanism 3 depends upon the slope and rate of rotation of the horizontal retort. The spent shale is carried out by screw and/or belt conveyor to the gas producer (discussed above) and shown as 4*a* and 4*a'* respectively. FIG. 2B above is a cross-section of FIG. 2A. The remaining elements and numerals not already referred to in connection with Figures herein are: line 7 controlled by valve 7' for passage of oil vapors and hydrocarbon gases to fractionator 8 (FIG. 3) also line 5 in FIG. 2B for passage of combustion gases (7*a* in FIG. 2A is a fan to induce flow which may be used in all cases); special elements shown in 2A are: rotation elements comprising motor and gear mechanism and rollers upon which the horizontal retort rests, and receiver Rx and additional elements necessary for spent shale discharge and removel. The arrangements of FIG. 2A and the other Figures may be varied as a matter of convenience with respect to location of the gas producer, etc., of source of heat generally, and the facilities supplied to transport the spent oil shale as well as for treatment of the ash for additional use or disposition. Location of the latter facilities is also a matter of choice and convenience.

In general, it is noted that FIG. 1 is a type of fixed shell vertical vessel, (generally intended to represent a battery of a number of units of the type depicted, to be used as a preliminary step to prevent "stickiness" or pitch formation in the rotary retort (horizontal) second step as alternative in some cases to the rotary type, all of the fixed shell units may be in the same setting and receive their heat from the same source generally from hot gases enroute to the stack from the retort of second step of the process. It is noted that in this case as with all others the heating is indirect. It is further noted that the furnace or heating setting in FIG. 1 is a fire brick or similar cermaic material but the retort itself is iron or steel and as depicted herein to facilitate passage of the oil shale and residue. The principle of heating is the same as used in general with respect to keeping combustion gases 3' separate in all cases from the oil vapors and hydrocarbon gases 3 (as illustrated in FIG. 1) resulting from the decomposition of the descending oil shale to produce oil and gas in the vertical retort.

The foregoing sets forth the principle underlyin principles of the partial dehydration and retorting of oil shale in connection with my invention. The succeeding steps in the process are shown in FIG. 3 wherein the vapors and gases from the retort are passed through line 7", the fractionator 8 to separate the heavier oil from the light distillate overhead fraction comprising mainly gasoline, together with hydrocarbon gases, water vapor and ammonia etc., all of which pass through the condenser 10 and into the receiver 11.

Note that there is still a considerable water content in the oil shale, which may be utilized where necessary, after recovery of ammonia contained therein, or used as a solution of the latter. Also nitrogen bases are present in the overhead product. The vapors of the overhead fraction (consisting principally of a light oil and aqueous fractions) may be passed in FIG. 3 through line 9 controlled by valve 9′ and through water cooled condenser 10; and the resulting liquid and uncondensable hydrocarbon gases are then passed into receiver 11 from which the gases may be withdrawn through line and control valve 11‴. The water may be removed through line and valve 11⁗. Line 11″ on the receiver may be equipped with a fan or similar device which may be used as found necessary to create a slightly reduced pressure to induce the flow of gases. (The latter may prove expedient to assist in avoiding leaks within the retort). The hydrocarbon gases withdrawn from the receiver may be washed free of ammonia (with water) which may be recovered as such or as ammonium suplhate useful as fertilizer, etc.

The liquids in the receiver comprise a heavier water layer which is withdrawn through line and valve 11‴. (It is noted that it may be desirable to remove gases to another separator or receiver, with suitable valve control, and from there to storage). The light oil layer may be withdrawn through line and valve 11‴. Dissolved basic organic components in the water may be recovered. The light overhead distillate may be recovered and combined with the major distillate product of the process from Section B before refining the latter, or refined separately as described below. A portion of the light distillate is recycled into the top of the fractionator to control the physical properties of the overhead distillate. The distillate from the receiver may be pumped through line and valve (12 and 12″) into the top of the fractionator 8 to accomplish this objective. The heavier oil withdrawn from the bottom of the fractionator through line 13′ and through suitable pump 13 if desired to a viscosity breaking stage but in the present case the hot oil is passed through line and valve 13″ to be sent to storage after cooling or by heat exchange. Line 13*b* controlled by valve 13*a* may be used to pump stored oil for viscosity breaking when necessary or desirable.

It is noted in connection with all of the above that applicant's process relates to surface retorting and that in situ or underground retorting represent a complete and unwarrented "school of thought", also it may be remarked in passing that the "in situ" process appears to have obvious defects such as lack in control in producing shale oil from the underground oil shale deposits. For example, there is complete ignorance of actual shale oil yields based on complete utilization of the underground oil shale to product shale oil. This is because the heat used to distill oil shale to shale oil product comes from combustion of an unknown and indeterminate part of the underground oil shale as well as complete lack of control of the same. There are, of course, other problems in the above connection.

With reference to various phases of economy with emphasis on fuel at the mine source, use and disposition of spent shale and oil shale ash and other pertinent questions, the following additional remarks are noteworthy. It is noted that in this connection the spent shale is about 84% of the original oil shale, and the ash is about 61%, with about 23% of fixed carbon, but will vary somewhat with different shales.

With further regard to the producer gas operation to furnish fuel for self-sufficiency and economy of the process in providing fuel (in addition to the hydrocarbon gases produced) for the overall operation. The basis for this in the case of the producer gas is the conversion of the fixed carbon in the spent oil shale (amounting to about ¼ to ⅓ by weight of the latter depending on the oil shale), and its utilization for fuel. It also serves to clean up the spent shale for the other uses referred to below. In the producer gas process as discussed above, the spent shale passes from the retort in FIG. 1 and is carried by the conveyor (illustrated by the screw or ribbon type), 4*a* while still hot into the gas producer FIG. 4. The latter previously described may be defined as a vessel containing a thick layer of subdivided solid fuel, high in carbon, through which air or a mixture of air and steam is passed with the object of converting the carbon of the spent oil shale to a gaseous fuel, illustrated by lines 4′ and 4″. In this connection, when air is used alone, the fuel is largely carbon monoxide; when steam is added, hydrogen as well as additional carbon monoxide is formed so that the fuel mixture may be carbon monoxide and hydrogen with some nitrogen and carbon dioxide resulting from the reaction. Established principles in connection with both producer gas and water gas and combinations thereof are observed in this connection in addition to the novel uses in the present connection.

With regard to the flow of the shale ash from the gas producer, it may pass through the bottom of the producer 4 controlled by element 4*b*, the major portion passing into spent shale storage for return to the mining excavation from which the oil shale is removed, in the interest of restored ecology, as well as being utilized for a large number of products and uses as set forth in my issued patent. Product gas from the gas producer is recovered via lines a.

It must also be borne in mind that the gas resulting from the retorting of the shale oil itself as indicated above is an important source of high BTU fuel.

Another important source of fuel or heat is obtained by heat exchange of the combustion gases both from the retorts FIG. 1 and the heating operation for viscosity breaking connected with FIG. 2.

In addition to partial dehydration of the oil shale at relatively lower temperatures, a rapid rate of production of the oil vapors are somewhat higher temperatures is desirable from the viewpoint of capacity as well as yield, for exmaple, an oil yield of about 45 gallons per ton of shale in less than two hours at a temperature of about 970° F. was observed whereas at about 870° F. drops the yield still further. In this particular case the shale was partially reduced to various size (down to about ¼ inch) which indicates a wider range in this respect. It is expected, therefore, that quick retorting, e.g., at between 950° F. and 1000° F. (i.e., at higher temperatures and shorter periods of time) could result in larger throughouts or capacity and less exposure of the oil vapors at high temperatures, all of which are important factors in the economy of high capacity oil shale operations. However, from the data to date, this type of operation, especially in addition to the partial dehydration as described herein, appears very promising especially in connection with much higher capacities of the high temperature retort section as a result of the operation referred to above. It is also noted in passing that the presence of some steam in the high temperature retort within limits is helpful both to rapid retorting and higher yields especially in connection with the novel design and use of retorts disclosed by me as well as conditions of operation particularly including the partial dehydration pretreatment of the oil shale disclosed herein. The operations connected therewith all lead to an industrialized oil shale industry not heretofore disclosed particularly from the viewpoint of capacity and of variety of fuel distillate products commensurate with the modern petroleum industry. It may also be further noted that as a measure of economy, the use of the oil shales fines, within limits, together with somewhat larger pieces 1" to 1.5" of oil shale tend to increase the quantity of oil proportionately and apparently reduces time of retorting. However, there is some evidence that too great a proportion of fines may reduce the overall yeilds of oil. In this connection it is pointed out that the fines may be employed as fuel if necessary, e.g. in connection with the retorts; much like powdered coal and the latter may likewise be employed if available and necessary for fuel and/or power. In any event, the sources of by-product processing fuel for all operations at the mine appears assured.

The novel process of the parent invention permits the transport of the shale oil by pipeline to the refinery where it may be refined into the products referred to above, utilizing cracking and refining equipment and making products already described in the parent cases; and to this extent in addition to facilitating transportation as well as defining operations at the refinery, and simplifying the operations at the mine. The latter is a very important factor in the development of a full scale fuel distillate industry from oil shale comparable in capacity to the present day operation in the petroleum industry; made possible by the novel features of the present invention.

As already pointed out above, it is highly desirable if not necessary, mainly from the operating as well as the economic viewpoint, to carry out the primary operations of my process on the vicinity of the deposits where the oil shale is mined because of the cost and impractability of transportation of the oil shale etc., the probable use of the oil shale ash as refill material and other important reasons rather than to locations otherwise more suitable on an all around basis for processing. However, the liquid products of my process may be piped to a conveniently located refinery for final treatment (e.g. cracking and refining) into marketable products as described, or otherwise transported.

The recovery of heat relates to either or both sections A and B of my process: a number of examples of which have already been set forth above; and others which may be utilized. I have already pointed out a number of such sources of heat and valuable uses of otherwise waste heat which should suffice as examples thereof.

It is time that the questions of re-allocation of water be made on a practical basis, (having in mind also that the Colorado River rises in the major oil shale area, namely the Green River Formation); as well as the critical nature of the problem to the welfare of the nation. Moreover, this problem my be largely resolved by the application of elementary water technology e.g., a reservoir (preferably at a high elevation) for cooling by recirculation, and the use of by-products for occasional treatment of the water if necessary. Similar elementary devices such as overhead "trolley and cable" transportation may be found useful in moving shale for treatment and/or waste products for fill.

Having described my invention and modifications thereof in considerable detail, it is interpreted in accordance with the broad scope and spirit of the same; as well as for its great importance both to our present and prospective future energy situation; and to a high degree the future independence of the nation in respect thereto.

I claim:

1. A continuous process for the production of the shale oil and other products from oil shale which includes removing a relatively small, up to substantial amounts, of the water present in the oil shale in the first step of the process prior to recovery of the major amount of the oil by retorting the same to avoid sticky or pitch deposits and interference by the latter in the retorting step of the process which comprises subjecting the said oil shale in subdivided form to a preliminary step of indirect heat treatment in a partial dehydration step, collecting the vapors and gases from the said partial dehydration step in the temperature range from the ambient up to about 212° F. to about 550° F. to remove small, up to relatively large amounts of free and combined water from the oil shale, thereafter passing the heated partially dehydrated oil shale to the retorting step for further heat treatment at a substantially higher temperature than the preliminary step in the approximate range of about 800° F. to 1000° F. in a rotating substantially horizontal cylindrical vessel said heat treatments in the partial dehydration and retorting steps being effected by indirect heat exchange with hot combustion and flue gases therefrom which gases are not in direct contact with the oil shale, said further heat treatment being conducted while rotating the partially treated oil shale in a substantially horizontal cylindrical vessel, withdrawing the vapors and gaseous products resulting from the heat treatment of the said partial dehydration and retorting steps of the process, fractionating the vapors withdrawn from the retorting step whereby there is removed a light overhead product comprising vapors of low boiling hydrocarbons, water, hydrocarbon gases and ammonia wherein the heavier conversion oil products from the oil shale are condensed and separated as a liquid for further treatment and use.

2. A process as described in claim 1 wherein the preliminary partial dehydration step is carried out in a fixed shell vertical cylindrical vessel.

3. A process as described in claim 1 wherein the preliminary partial dehydration step is carried out in a rotating substantially horizontal cylindrical vessel of considerably less volume capacity than that used in the retorting step of the process.

* * * * *